US007581570B1

(12) United States Patent
Lamke

(10) Patent No.: US 7,581,570 B1
(45) Date of Patent: Sep. 1, 2009

(54) SYSTEM AND METHOD OF SUPPORTING FUEL NOZZLES IN A FUELING POSITION

(76) Inventor: Travis Lamke, 4408 S. 179th St., Omaha, NE (US) 68135-3654

( * ) Notice: Subject to any disclaimer, the term of this patent is extended or adjusted under 35 U.S.C. 154(b) by 169 days.

(21) Appl. No.: 11/517,845

(22) Filed: Sep. 8, 2006

(51) Int. Cl.
*B65B 1/04* (2006.01)
*A62C 13/76* (2006.01)

(52) U.S. Cl. ..... 141/1; 141/2; 141/86; 141/98; 141/387; 248/75

(58) Field of Classification Search ..... 141/1, 141/2, 59, 86, 98, 206, 387, 392; 296/97.22; 248/75–78
See application file for complete search history.

(56) References Cited

U.S. PATENT DOCUMENTS 1,592,556 A * 7/1926 Canaan, Jr. ..... 248/78
3,291,165 A * 12/1966 Fraylick ..... 141/286
3,941,412 A * 3/1976 Carpenter ..... 294/74
4,537,437 A * 8/1985 Buccola ..... 296/97.22
5,007,605 A * 4/1991 Horvath ..... 248/62
5,433,288 A * 7/1995 James ..... 182/3
6,113,039 A * 9/2000 Riffle ..... 248/75
6,422,521 B1 * 7/2002 Tinklepaugh et al. ..... 248/75

* cited by examiner

*Primary Examiner*—Timothy L Maust
(74) *Attorney, Agent, or Firm*—Holland & Hart LLP

(57) ABSTRACT

A system for supporting a fuel delivery device in a fueling position with respect to a vehicle is provided with an elongated retaining member, having first and second ends. The first end removably couples with a portion of the fueling system. The second end of the retaining member is coupled with the vehicle. Various structural devices are provided for coupling the retaining member with the fuel delivery device as well as the vehicle. Various safety designs provide a detachable coupling with the vehicle. The retaining member may be provided to be length adjustable to customize its use.

16 Claims, 8 Drawing Sheets

SYSTEM AND METHOD OF SUPPORTING FUEL NOZZLES IN A FUELING POSITION

BACKGROUND

Fuel delivery devices, typically having a fuel nozzle and hose coupled with a pump that is associated with a storage tank, can be found in countless commercial and private locations. Commonly, individuals use fuel delivery devices to fill fuel tanks associated with a vehicle. While fueling the vehicle, many individuals will take advantage of devices associated with the fuel nozzle for locking the lever on the fuel nozzle in an open position. While the fuel is being deposited within the fuel tank, the individual is then free to perform other tasks related to servicing the vehicle, paying for the fuel, and the like. It is not uncommon, however, for the fuel nozzle to accidentally fall from within the fill opening of the fuel tank. This can have disastrous results due to the fact that the fuel nozzle lever remains locked in an open position, spilling fuel on and around the vehicle. Clearly, such an accident poses serious dangers to surrounding individuals and property, let alone the environment. Where no such damage occurs, fuel spills of these types can be time-consuming and expensive to clean.

The over-the-road trucking industry is particularly susceptible to fuel spills caused by locked fuel nozzles falling from fuel tanks. The typical over-the-road vehicle is provided with fuel tanks on both sides of the vehicle. These fuel tanks oftentimes have oversized fill openings. Over the years, individuals have tried to develop systems and methods for retaining fuel nozzles within these fuel tanks. Some individuals turn the fuel nozzle upside down as it is passed through the fill opening of the fuel tank. In this position, the spout of the fuel nozzle engages the upper portion of the fuel tank. While such a position may experience a limited success in securing the fuel nozzle with respect to the fuel tank, its position is precarious and fails to adequately remedy the problem at hand.

Another prior art attempt at resolving the present problem provides an elongated, hook-shaped structure that extends outwardly from the upper end portion of the fuel nozzle, adjacent the spout. In many instances, the fill opening of over-the-road vehicle fuel tanks will be sufficiently sized to simultaneously receive the spout and hook structure of such fuel nozzles. In these instances, the spout of the fuel nozzle is positioned at the lower end of the fill opening and the hook extends through the fill opening and engages an upper portion of the fuel tank. This system is certainly an improvement over the simple method of turning the fuel nozzle upside down while it is being used. Unfortunately, the system works all too well when the user forgets that the fuel nozzle is coupled with the fuel tank. This may frequently happen when an over-the-road vehicle operator is simultaneously filling the two fuel tanks and accidentally leaves one of the fuel nozzles engaged with one of the fuel tanks. As the operator drives away from the fuel delivery device, the fuel nozzle remains coupled with the fuel tank and the hose of the fuel delivery device is detached from the fuel pump. Clearly, this instance is far more dangerous than the problem of having the fuel nozzle accidentally fall from the fuel tank. Moreover, such solutions require the owners of fuel delivery devices to retro-fit or upgrade every fuel nozzle within their service. This can become costly to implement and maintain. Moreover, various liabilities may arise for such owners when the aforementioned accidents occur.

Accordingly, what is needed is a novel system and method of supporting fuel nozzles in a fueling position that substantially prevents fuel nozzles from unintentionally falling from fuel tanks. However, such a system and method should be provided with safety designs that substantially prevent fuel nozzles from being detached from associated fuel delivery devices when an operator forgets that the fuel nozzle is associated with the delivery device and drives away.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The system and method of supporting a fuel delivery device in a fueling position with respect to a vehicle is provided with an elongated retaining member having opposite first and second end portions. The first end portion of the retaining member is provided with a coupling structure for releasably connecting the retaining member with the fuel delivery device. The second end portion of the retaining member is operatively coupled with the vehicle. In use, the fuel delivery system may be positioned adjacent the vehicle's fuel tank and the fuel nozzle may be operatively associated with the fill opening of the fuel tank to dispose fuel therein. The coupling device may then be engaged with a portion of the fueling system to ensure that the fuel nozzle remains associated with the fuel tank.

One aspect of the system wraps at least a portion of the first end portion of the retaining member around one of various different structures associated with the fuel delivery device. In one example, openings are formed along a length of the retaining member that are sized and shaped to securably receive a post member, which is secured to the retaining member. Accordingly, as the second end portion is wrapped around the fuel delivery device, the user may easily secure the system. In another example, a coupling block is associated with the first end portion of the retaining member. The retaining block is provided with a locking arm that is moveable between open and closed positions. In use, the operator positions a portion of the fuel delivery device adjacent the coupling block and secures the locking arm in a closed position, securing the fuel delivery device between the coupling block and the locking arm.

Another aspect of the system may provide a retaining member that is adjustable in length to allow the user to customize the mounting of the system and provide greater flexibility in its use. In one example, the retaining member is provided in at least two separate lengths that are operatively and releasably securable with one another along their respective lengths. Various structural features may be provided for securing the separate lengths with respect to one another.

Still another aspect of the present system provides a mounting bracket that may be operatively coupled with the second end portion of the retaining member to secure the system to the vehicle. Various different embodiments of the mounting bracket may be provided as well as various methods of securing the same to the vehicle and/or the retaining member. Some methods of securing the mounting bracket with the vehicle permit the bracket to be easily detached therefrom in the event that an operator begins to drive away from the fuel delivery device with the fuel nozzle coupled with the system and the fuel tank. Other methods may provide detachable structural features between the mounting bracket and the retaining member.

It is therefore a principle object of the present invention to provide a system and method of safely supporting a fuel delivery device in a fueling position with respect to a fuel tank on a vehicle.

A further object of the present invention is to provide a method of supporting a fuel delivery device in a fueling position with respect to a vehicle using an elongated retaining member that is coupled at one end with the vehicle and coupled with a portion of the fuel delivery device at an opposite end.

Still another object of the present invention is to provide a system and method of supporting a fuel delivery device in a fueling position with respect to a vehicle that provides various structural devices for coupling a retaining member with a portion of the fuel delivery device in order to provide a system that is relatively easy to use.

Yet another object of the present invention is to provide a system and method of supporting a fuel delivery device in a fueling position with respect to a vehicle that uses a length-adjustable retaining member that is operatively associated at one end with the vehicle and at an opposite end with a portion of the fuel delivery device.

A further object of the present invention is to provide a system and method of supporting a fuel delivery device in a fueling position with respect to a vehicle that provides one or more various structural arrangements that render the system removably engaged with the vehicle such that the system will be removed from the vehicle before damage could occur to the fuel delivery device when an operator drives away without disengaging the fuel delivery device from the vehicle.

Yet another object of the present invention is to provide a system and method of supporting a fuel delivery device in a fueling position with respect to a vehicle that is relatively simple and inexpensive to manufacture.

These and other objects of the present invention will be apparent after consideration of the Detailed Description and Figures herein.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
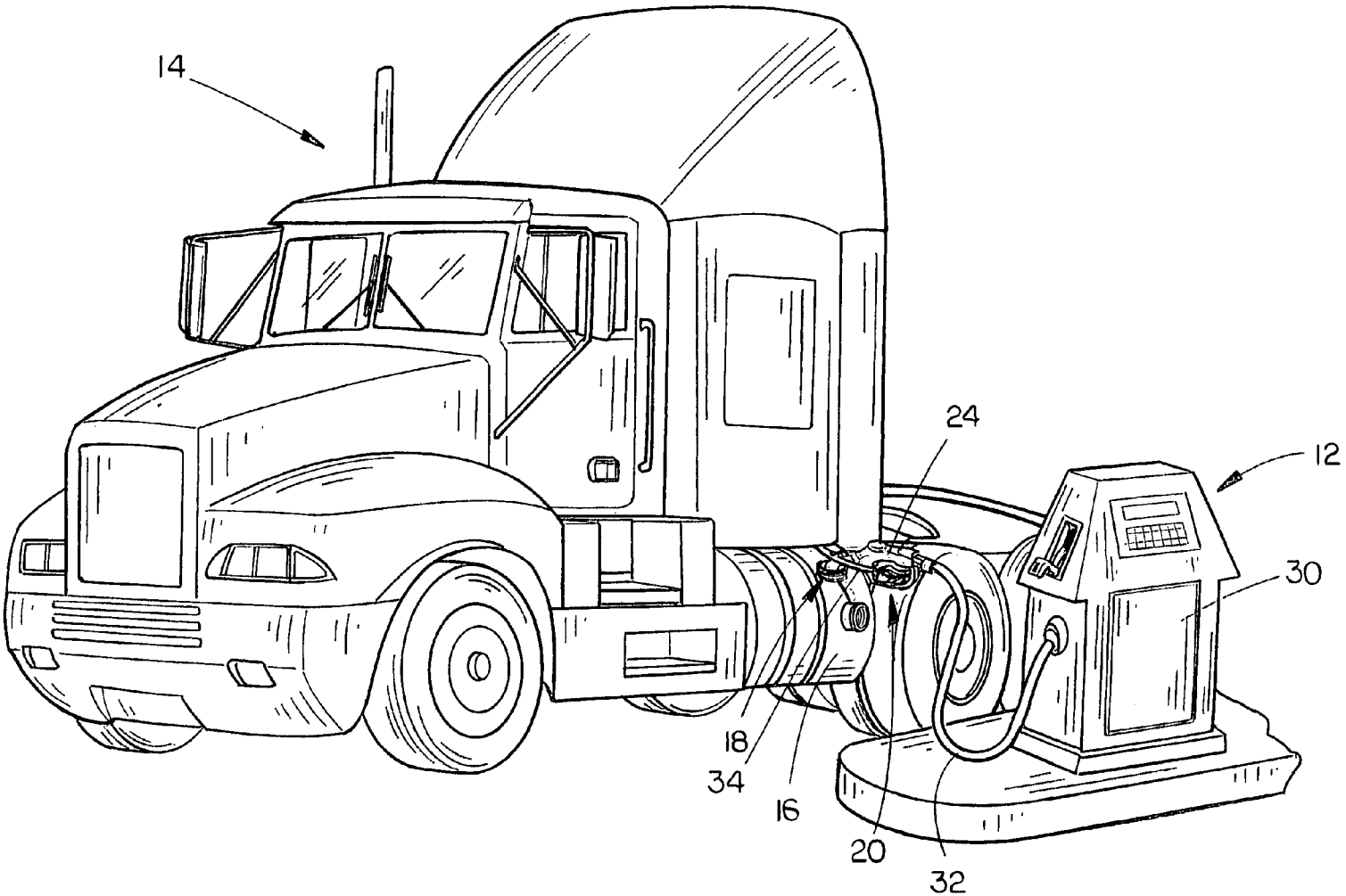
FIG. 1 depicts a perspective view of one preferred manner in which the method of supporting a fuel delivery device may be used with a vehicle and a fuel delivery device.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

A retaining assembly 10 is provided for supporting a portion of a fuel delivery device 12 in a fueling position with respect to a vehicle 14. Many different vehicles are contemplated for use with the retaining assembly 10. However, the vehicle 14 will at least be provided with a fuel tank 16 having a fill opening 18. Likewise, various fuel delivery devices 12 are contemplated for use with the retaining assembly 10. Such fuel delivery devices 12 will commonly be provided with a fuel nozzle 20, having a spout 22, a handle 24, an actuating lever 26 and a lever guard 28. The fuel nozzle 20 will typically be associated with a pump 30 via a hose 32.

In a preferred embodiment, the retaining assembly 10 is provided with an elongated retaining member 34, having a first end portion 36 and a generally opposite second end portion 38. While it is contemplated that the retaining member 34, or a portion thereof, may be formed from a rigid or semi-rigid material, it will be preferred that the retaining member be comprised of a generally flexible material in order to promote greater adaptability and ease of use.

The first end portion 36 of the retaining member 34 is preferably provided with a coupling means for releasably connecting the retaining member 34 with a portion of the fuel delivery device 12. In one embodiment, the coupling means may be provided by simply wrapping at least a portion of the first end portion 36 of the retaining member 34 around a portion of the fuel delivery device 12. In one embodiment, depicted in FIG. 1, the first end portion 36 may be wrapped around the handle 24 of the fuel nozzle 20, adjacent the actuating lever 26. In another embodiment, depicted in FIG. 2, the first end portion 36 may be wrapped around a proximal end of the spout 22, adjacent the handle 24. Likewise, it is contemplated that the first end portion 36 may be wrapped around a distal end portion of the hose 32, adjacent the fuel nozzle 20 or, alternately, a portion of the lever guard 28.

Figure 3:
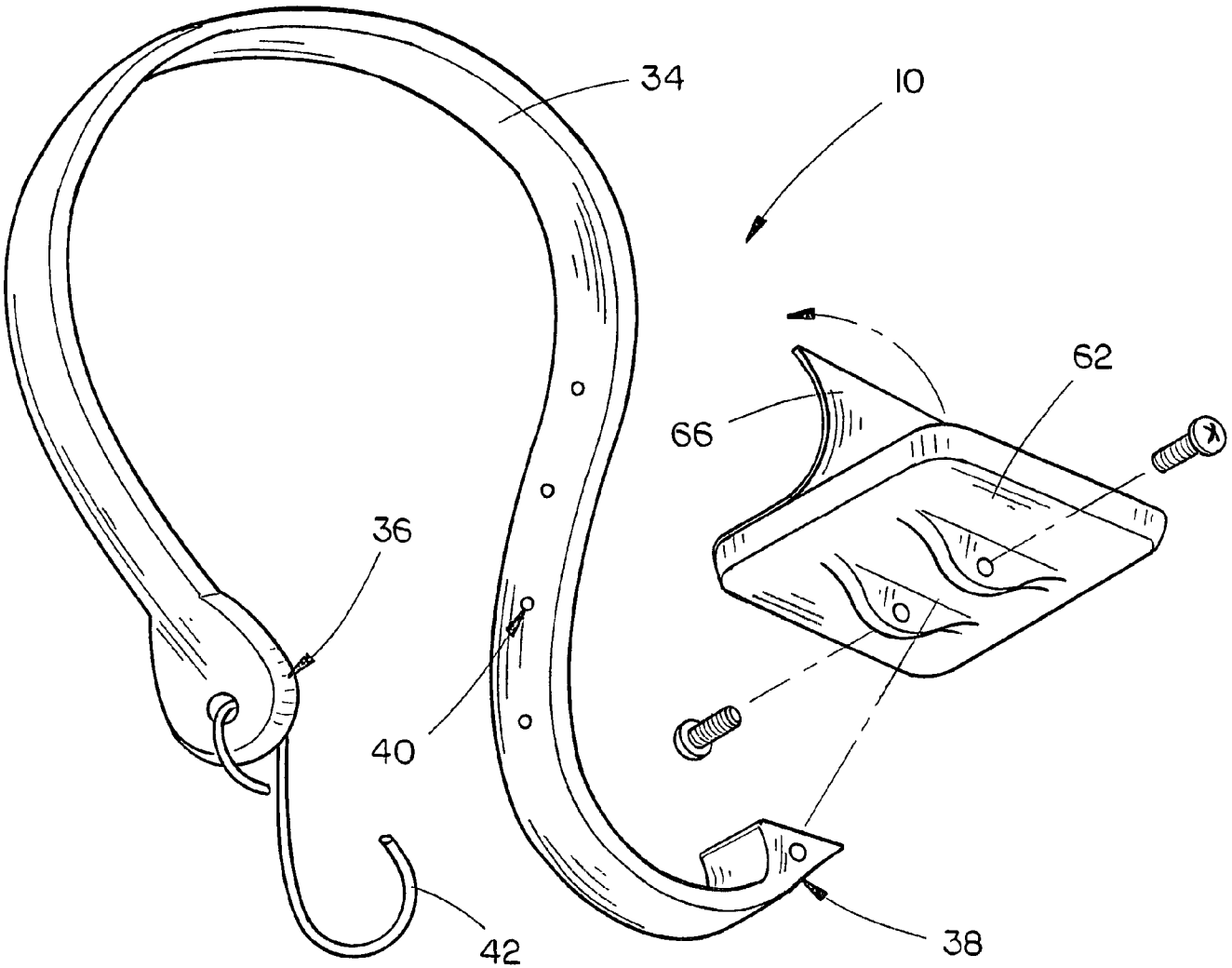
FIG. 3 depicts a partially exploded, isometric view of one preferred retaining assembly that may be used with the method of supporting a fuel delivery device.
Figure 4:
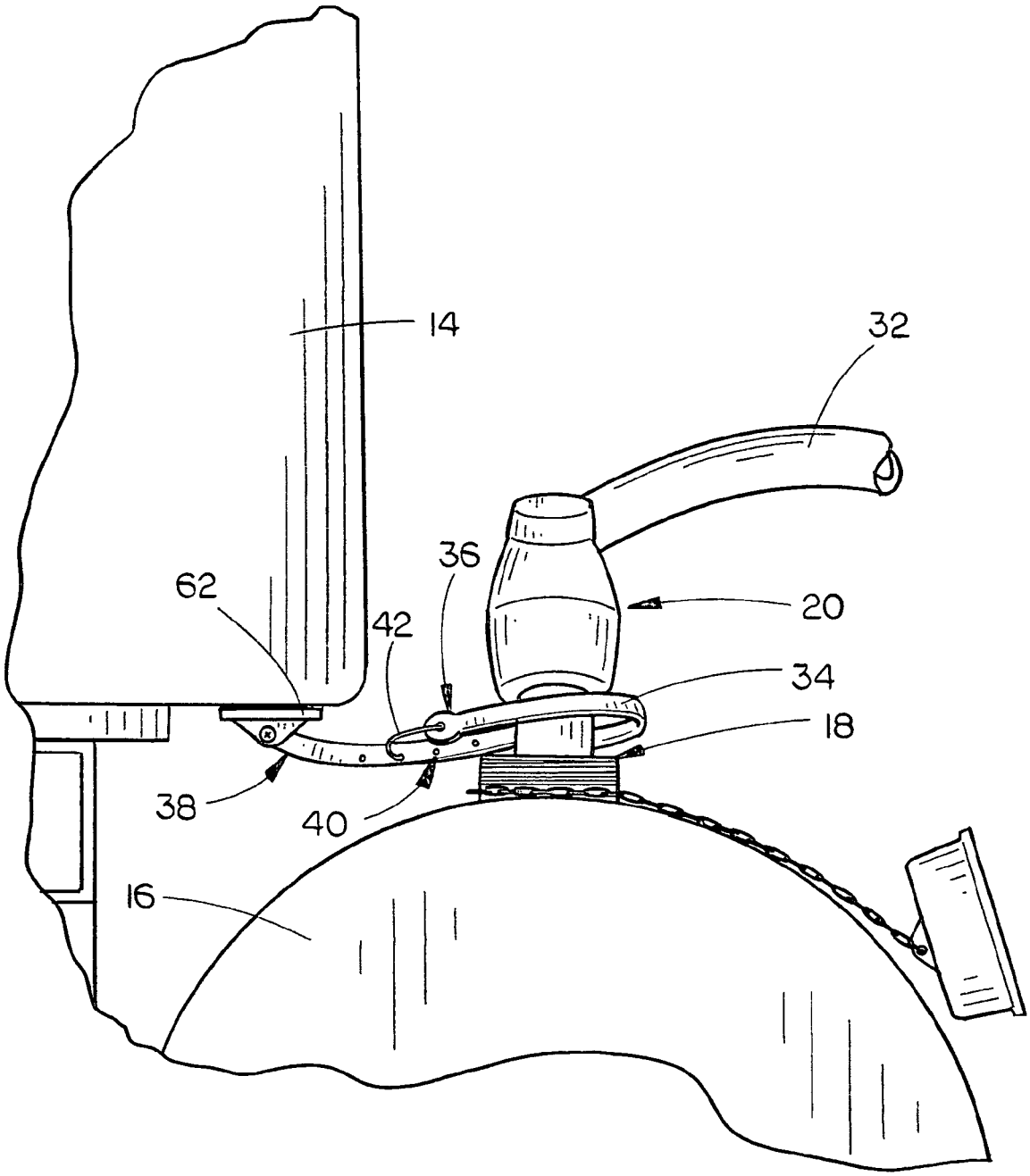
FIG. 4 depicts the retaining assembly of FIG. 3 as it may be used to help retain the fuel nozzle of a fuel delivery device adjacent the fuel tank of a vehicle.

In order to secure the first end portion 36 of the retaining member 34 around a portion of the fuel delivery device 12, the coupling means may be provided with various securement means. One preferred embodiment provides the securement means with one or more openings 40, along a length of the retaining member 34 and a post member 42, secured to the retaining member 34, that is shaped and sized to be passed through the one or more openings 40 so that the first end portion 36 of the retaining member 34 may be secured to a point along the retaining member 34 between its first end portion 36 and its second end portion 38. One example of the shape in which the post member 42 may be formed is depicted in FIG. 3 as a generally hook-shaped member. Other mechanical fasteners, such as snaps, hooks-and-eyes, and the like are contemplated. Alternately, the securement means may be provided in the form of hook-and-loop fastening material 44, such as that depicted in FIG. 10, but disposed along the retaining member 34 in place of the openings 40 and post member 42 or other mechanical fasteners.

Figure 7:
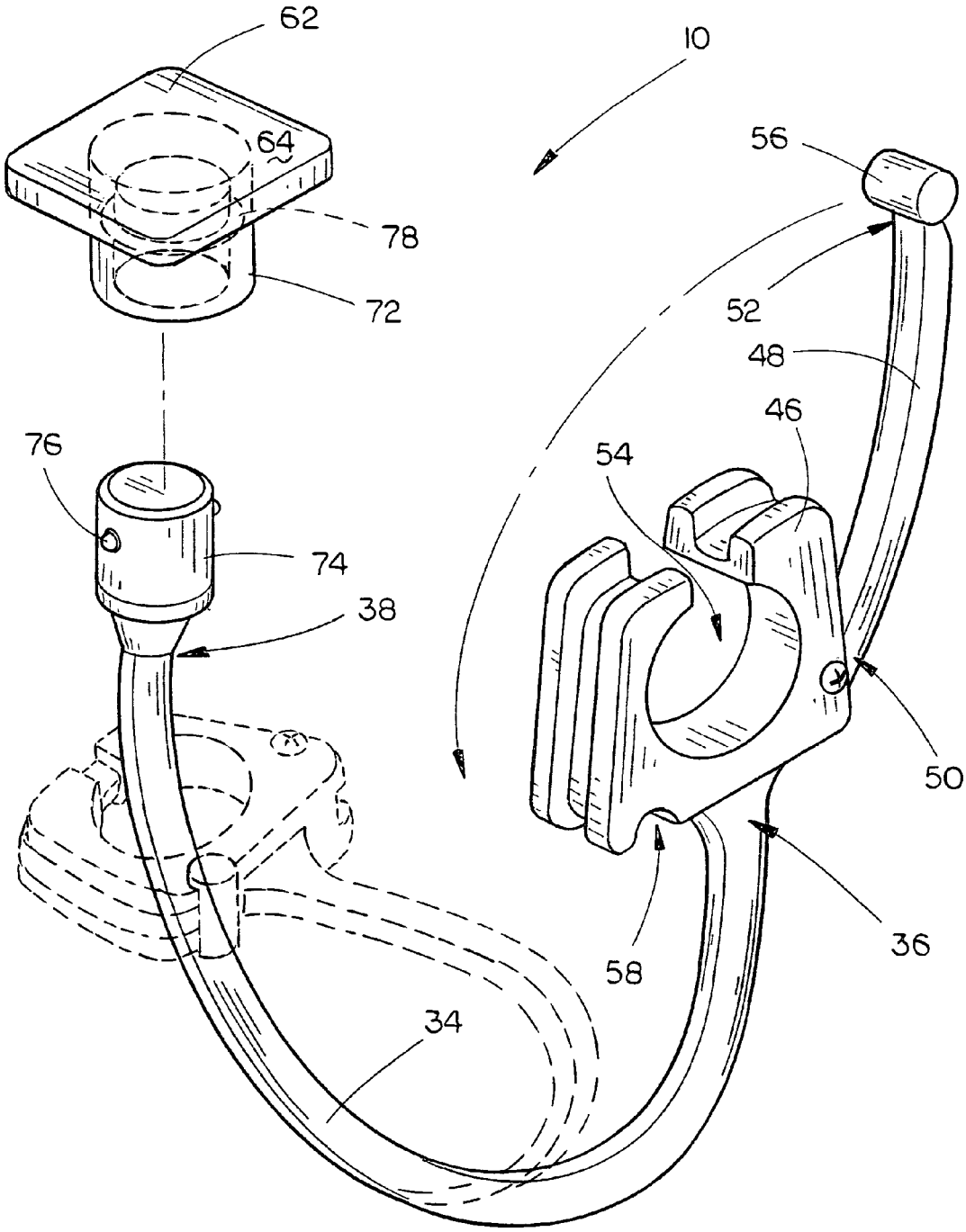
FIG. 7 depicts an isometric view of another preferred retaining assembly that may be used with the method of supporting a fuel delivery device.

In another preferred embodiment, the coupling means may be provided with a coupling block 46, such as that depicted in FIG. 7. A locking arm 48 having a first end portion 50 and a second end portion 52 is preferably associated with the coupling block 46. In one preferred embodiment, the first end portion 50 of the locking arm 48 is pivotably coupled with the coupling block 46 so that it is moveable between open and closed positions with respect to the coupling block 46. The coupling block 46 and the locking arm 48 should be shaped and sized to securably receive a portion of the fuel delivery system between the coupling block 46 and the locking arm 48 when the locking arm 48 is in the closed position. For example, FIG. 7 depicts the coupling block 46 as having a recess 54 formed therein that is shaped to receive a portion of the fuel delivery system, such as the spout 22, handle 24, lever guard 28 or hose 32. The locking arm 48 is positioned to enclose the recess 54 when the locking arm is in its closed position. While it is contemplated that the locking arm 48 may be comprised of a rigid or semi-rigid material, it may be preferable to form the locking arm 48 from a resiliently deformable material, so that it may be easily pulled taut and secured in its closed position while slightly deforming around any portion of the fuel delivery device 12 that may protrude outwardly from the recess 54. A securing post 56 may be provided at the second end portion 52 of the locking arm 48 for releasable engagement with a lock recess 58 that is formed within the coupling block 46. An optional grappling post 60 may extend outwardly from the securing post 56 or a portion of the locking arm 48 to provide a user with an easy manual means of securing the locking arm 48 in its closed position and moving the same into its open position.

Figure 2:
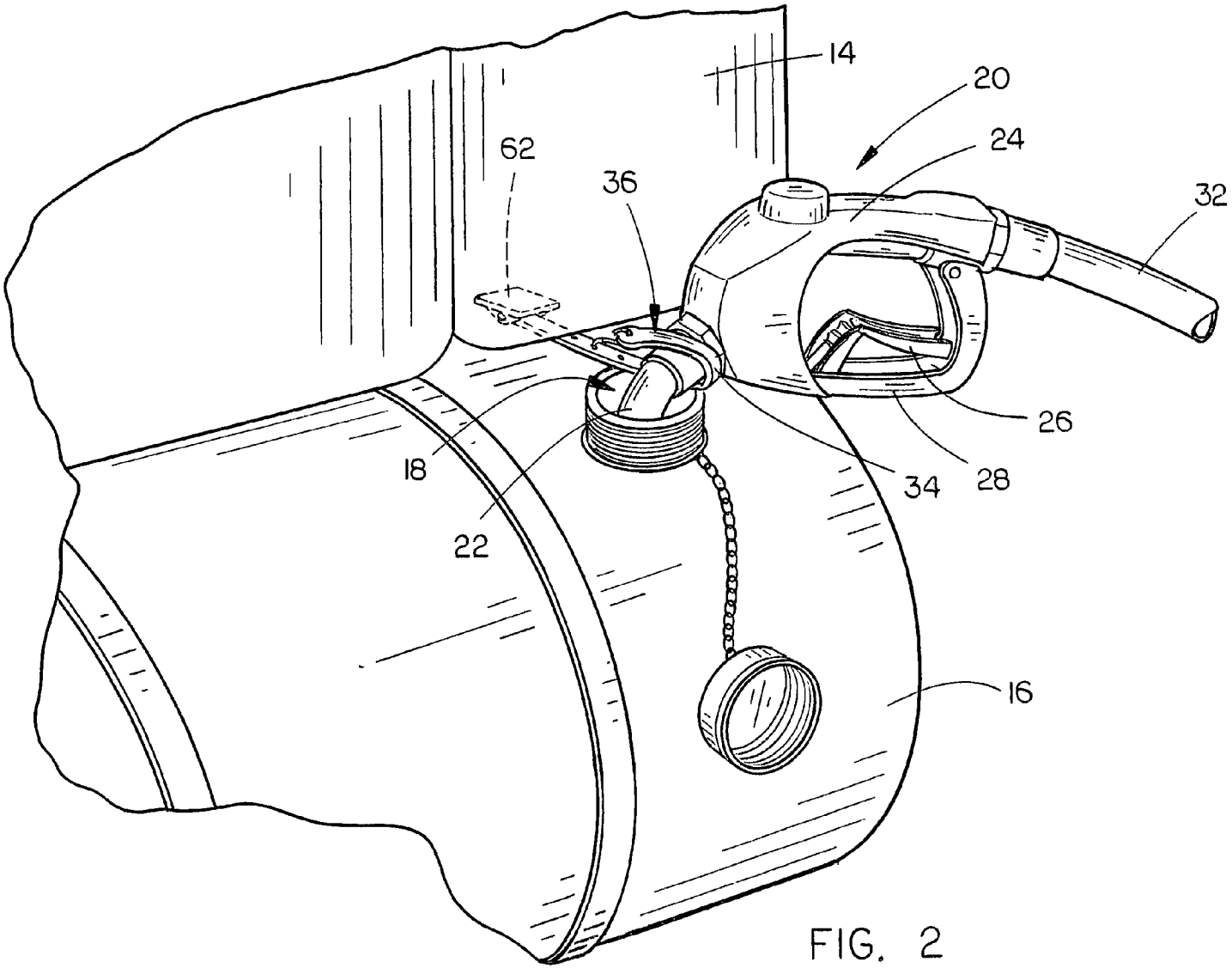
FIG. 2 depicts an isometric view of another preferred manner in which the method of supporting a fuel delivery device may be used to help retain the fuel nozzle of a fuel delivery device adjacent the fuel tank of a vehicle.
Figure 8:
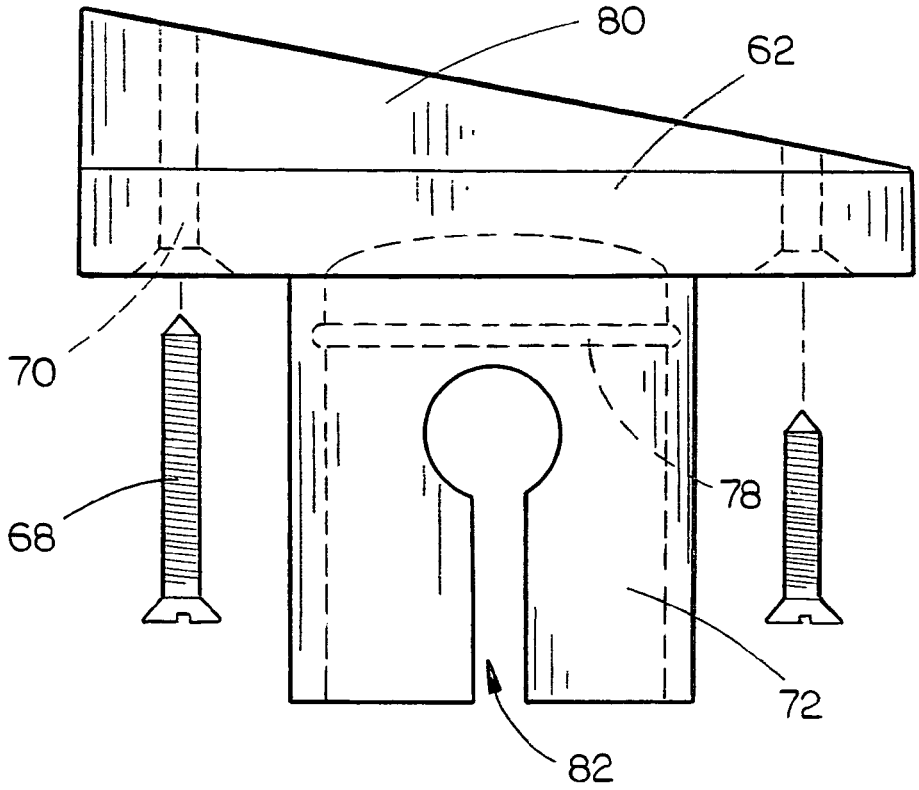
FIG. 8 depicts a side elevation view of one embodiment of a mounting bracket that may be used as a portion of a retaining assembly. in the method of supporting a fuel delivery device.

In a preferred embodiment, a mounting bracket 62 is operatively coupled with the second end portion 38 of the retaining member 34. While this connection may be static, a preferred embodiment, such as depicted in FIG. 3 pivotably couples the second end portion 38 of the retaining member 34 with the mounting bracket 62. This should provide greater ease of use and flexibility of the retaining assembly 10. A rearward surface 64 of the mounting bracket 62 should be secured to the vehicle 14 in a location that will permit the first end portion 36 of the retaining member 34 to extend to, but not significantly beyond, the fill opening 18 of the fuel tank 16. FIG. 2 depicts one such example, wherein the mounting bracket 62 is secured in a generally horizontal position to the lower surface of the cab of the vehicle 14. In such an instance, it may be advantageous to utilize an adhesive of various types, including a pressure-sensitive adhesive pad 66, to secure the rearward surface 64 of the mounting brackets 62 to the vehicle 14, due to the restrictive space of the mounting location. Alternately, when desirable, fasteners of various types, such as the screws 68 depicted in FIG. 8 may be used to secure the mounting bracket 62 to the vehicle 14. To that end, one or more openings 70 may be formed through the mounting bracket 62 for ease of final assembly. While the mounting bracket 62 is generally depicted as being mounted in a generally horizontal position to the body of the vehicle 14, it is contemplated that the mounting bracket 62 may also be mounted in a generally vertical position to the body of the vehicle 14, as well as other structures associated with the vehicle 14, such as the frame, and the like. In some instances, it is contemplated that the mounting bracket 62 may even be coupled with the fuel tank 16 itself.

In order to promote safety in the event that a user should drive away from the fuel delivery device 12 with the fuel nozzle 20 in its fueling position with respect to the fueling tank 16 and the retaining assembly 10, it may be desirable to have the retaining assembly 10, or a portion thereof, be automatically detachable from the vehicle 14. In one example, the use of the adhesive pad 66 to secure the mounting bracket 62 with the vehicle 14 will provide an acceptable level of detachability. In such an instance, the mechanical connection between the adhesive pad 66 and the vehicle 14 will likely be the weakest structural link along the retaining assembly 10 and throughout the fuel delivery device 12, such that, as more than moderate pressure is applied along the retaining assembly 10, the adhesive pad 66 will detach from either or both of the mounting bracket 62 and the vehicle 14.

Another preferred embodiment associates a socket 72 and post connector 74 with the second end portion 38 of the retaining member 34. FIG. 7 depicts the socket 72 as extending outwardly from the mounting bracket 62, while the post connector 74 extends from the second end portion 38 of the retaining member 34. However, it is contemplated that the two structures may be reversed in position. Preferably, the post connector 74, is shaped and sized to be removably received within the socket 72. While a tight tolerance, friction fit may be provided between the two structures, one or more pins 76 and a channel 78 may be provided to mate with one another when the post connector 74 is disposed within the socket 72 in order to secure the structures with one another. In the event that a user drives the vehicle 14 away from the fuel delivery device 12 with the fuel nozzle 20 operatively coupled with the fuel tank 16, it is contemplated that the connection between the socket 72 and the post connector 74 will be the weakest link along the retaining assembly 10 and the fuel delivery device 12, separating with minimal force being applied thereto.

Figure 9:
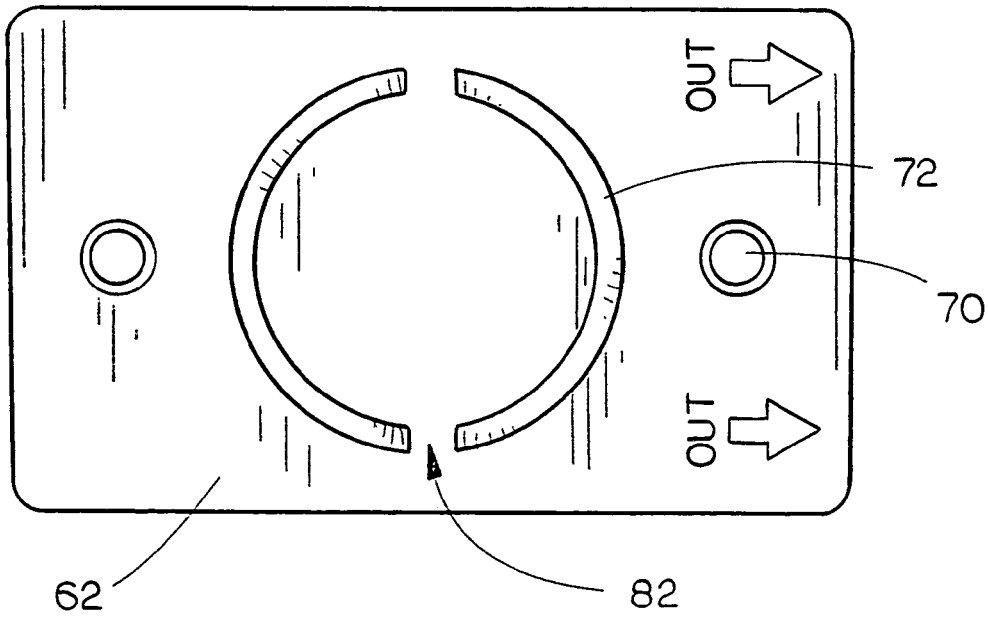
FIG. 9 depicts a top plan view of the mounting bracket of FIG. 8.

It is contemplated that when the vehicle 14 drives away from the fuel delivery device 12, that the retaining member 34 may be pulled at an angle with respect to the mounting bracket 62, increasing the force required to separate the post connector 74 from the socket 72. In such an instance (and even when an adhesive pad 66 is used in place of the socket and post connector) the socket 72 and post connector 74 should be positioned so that a long axis extending therethrough is positioned to generally point in the direction of the fill opening 18 in the fuel tank 16. This may be accomplished by forming the socket 72 to extend outwardly from the mounting bracket 62 at an angle or to provide one or more shims 80 along the rearward surface 64 of the mounting bracket 62. In an alternate embodiment, which may be combined with the angular relationship of the long axis extending through the socket 72 and the post connector 74, the socket 72 may be formed to have one or more vertical separations 82 that form a plurality of opposing segments within the body of the socket 72. These opposing segments will bias outwardly in a preferred embodiment when angular pressure is applied to the post connector 74. Where such structural devices, such as the shim 80 or the vertical separations 82 are utilized, it may be advantageous to display verbal or symbolic instructions, such as depicted in FIG. 9, on the mounting bracket 62 so that the user correctly orients the mounting bracket 62 when coupling the same with the vehicle 14.

Figure 6:
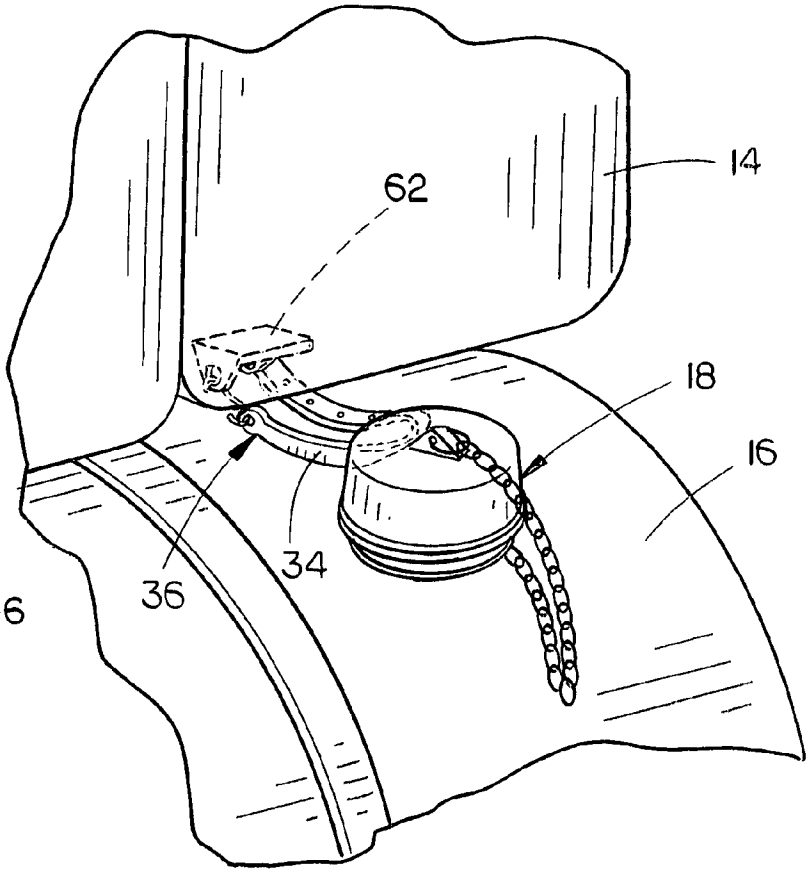
FIG. 6 depicts another preferred embodiment of the retaining assembly in an alternate travel position, coupled with a vehicle.
Figure 5:
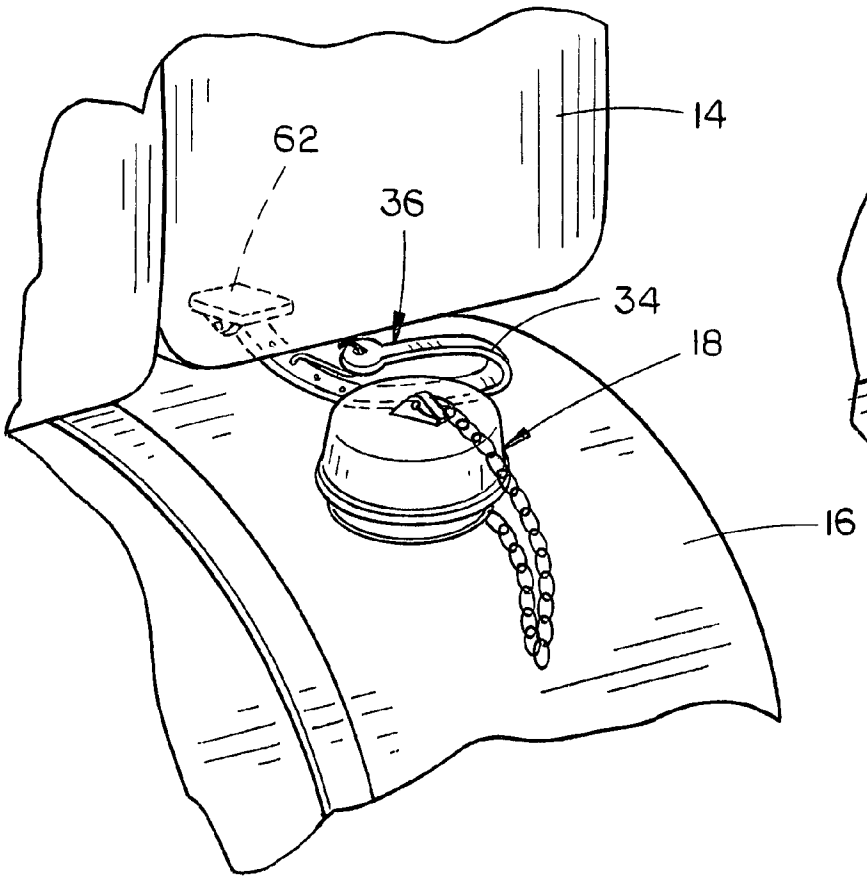
FIG. 5 depicts one preferred embodiment of the retaining assembly in a travel position, coupled with a vehicle.

When the retaining assembly 10 is not in use with the fuel delivery device 12 it will be desirable to place the retaining assembly 10 in one of various storage positions, such as those depicted in FIGS. 5, 6 and 7. Specifically, the means disposed adjacent the second end portion 38 of the retaining member 34 for securing the retaining assembly 10 with the fuel delivery device 12 should be able to be secured with a portion of the retaining assembly 10, adjacent the second end portion 38. The modifications and additional structures that will enable such a storage position are limited only by the imagination and those depicted are for example purposes only.

Figure 10:
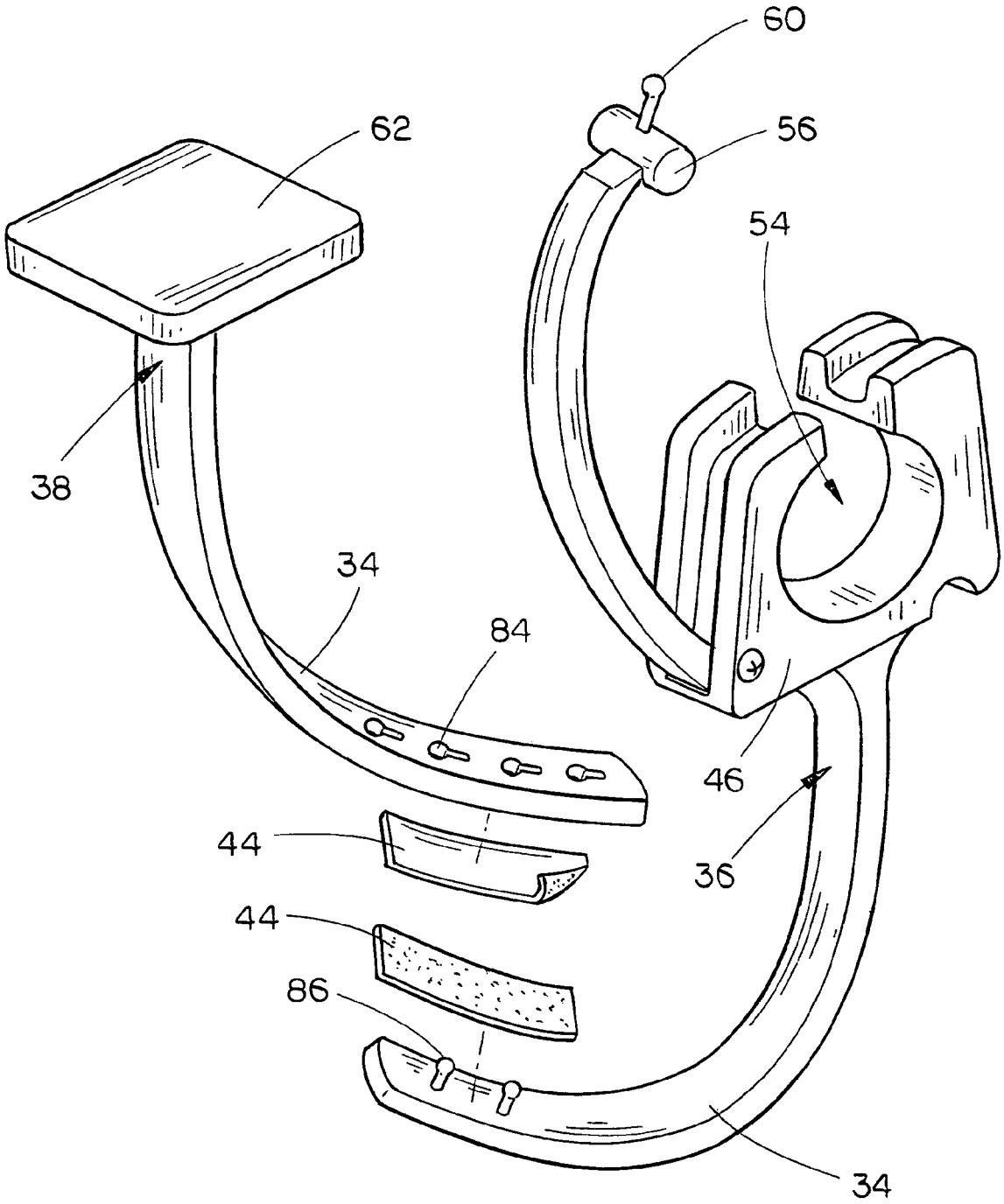
FIG. 10 depicts a partially exploded view of still another preferred embodiment of the retaining assembly in an alternate travel position, coupled with a vehicle.

According to the application in which the retaining assembly 10 is used and the structural details presented by the vehicle 14 on which the retaining assembly is disposed, it may be desirable to provide the retaining member 34 in a length-adjustable form. In one preferred embodiment, the retaining member 34 is comprised of at least two separate lengths, as depicted in FIG. 10, and provided with length adjustment means for removably securing the two separate lengths with one another in different positions so that the length of the retaining member 34 may be selectively adjusted. Various structural configurations may be provided for use as the adjustment means. One preferred embodiment simply utilizes hook-and-loop material 44 disposed on the opposing surfaces of the two separate lengths of retaining member 34. In another embodiment, where greater structural strength is required, a plurality of openings 84 may be formed in one of the separate lengths while one or more post members 86 extend outwardly from the opposite length of the retaining member 34. The openings 84 and post members 86 should be shaped and sized to be releasably secured with one another. One example may provide the openings 84 in a keyhole-shape and the post members 86 with a generally spherical bulb at their distal ends. Providing the length adjustment to the retaining member 34 will permit a greater array of mounting locations for the mounting bracket 62 and provide a greater adaptability of the retaining assembly 10 with various different styles of fuel delivery devices.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A method of supporting a fuel delivery device, having a fuel nozzle and hose, in a fueling position with respect to a vehicle having a fuel tank with a fill opening, the method comprising:

providing an elongated retaining member having opposite first and second end portions; said first end portion having coupling means for releasably connecting said retaining member with the fuel delivery device; said retaining member being comprised of at least two separate lengths and provided with length adjustment means for removably securing said at least two separate lengths with one another in different positions so that the length of said retaining member may be selectively adjusted;

operatively coupling the second end portion of said retaining member with the vehicle;

positioning the fuel delivery device adjacent the fuel tank and operatively associating the fuel nozzle with the fill opening to dispense fuel within the fuel tank; and engaging said coupling means with said fueling device.

2. The method of claim 1 wherein said length adjustment means is comprised of hook-and-loop material coupled with said at least two lengths.

3. The method of claim 1 wherein said length adjustment means is comprised of a plurality of openings formed in at least one of said at least two lengths and at least one post member provided on another of said at least two lengths that is shaped and sized to be passed through said openings so that the at least two lengths may be secured with one another.

4. The method of claim 3 wherein said plurality of openings are keyhole-shaped and said at least one post member is shaped to be secured within said keyhole shape.

5. A method of supporting a fuel delivery device, having a fuel nozzle and hose, in a fueling position with respect to a vehicle having a fuel tank with a fill opening, the method comprising:

providing an elongated retaining member having opposite first and second end portions; said first end portion having coupling means for releasably connecting said retaining member with the fuel delivery device; at least a portion of said retaining member being comprised of a flexible material; said coupling means being comprised of securement means for releasably securing the first end portion of said retaining member around a portion of the fuel delivery device; said securement means being comprised of one or more openings formed in said retaining member and a post member, secured to said retaining member, that is shaped and sized to be passed through said one or more openings so that the first end portion of said retaining member may be secured to a point along said retaining member between its first and second end portions; said securement means being further comprised of hook-and-loop fastening material;

operatively coupling the second end portion of said retaining member with the vehicle;

positioning the fuel delivery device adjacent the fuel tank and operatively associating the fuel nozzle with the fill opening to dispense fuel within the fuel tank; and engaging said coupling means with said fueling device by wrapping at least a portion of the first end portion of said retaining member around a portion of the fuel delivery device.

6. A method of supporting a fuel delivery device, having a fuel nozzle and hose, in a fueling position with respect to a vehicle having a fuel tank with a fill opening, the method comprising:

providing an elongated retaining member having opposite first and second end portions; said first end portion having coupling means for releasably connecting said retaining member with the fuel delivery device; said coupling means being comprised of a coupling block having a locking arm, having opposite first and second end portions; that is movable between open and closed positions with respect to said coupling block; said coupling block and locking arm being shaped to securably receive a portion of the fuel delivery system between the coupling block and said locking arm when said locking arm is in said closed position;

operatively coupling the second end portion of said retaining member with the vehicle;

positioning the fuel delivery device adjacent the fuel tank and operatively associating the fuel nozzle with the fill opening to dispense fuel within the fuel tank; and engaging said coupling means with said fueling device.

7. The method of claim 6 wherein said coupling block is shaped to have a recess that is shaped to receive a portion of the fuel delivery system; said locking arm enclosing said recess when said locking arm is in said closed position.

8. The method of claim 7 wherein said locking arm is comprised of a resiliently deformable material.

9. A method of supporting a fuel delivery device, having a fuel nozzle and hose, in a fueling position with respect to a vehicle having a fuel tank with a fill opening, the method comprising:

providing an elongated retaining member having opposite first and second end portions; said first end portion having coupling means for releasably connecting said retaining member with the fuel delivery device; at least a portion of said retaining member being comprised of a flexible material; said coupling means being comprised of securement means for releasably securing the first end portion of said retaining member around a portion of the fuel delivery device; said securement means being comprised of one or more openings formed in said retaining member and a post member, secured to said retaining member, that is shaped and sized to be passed through said one or more openings so that the first end portion of said retaining member may be secured to a point along said retaining member betweenits first and second end portions;

operatively coupling the second end portion of said retaining member with the vehicle;

positioning the fuel delivery device adjacent the fuel tank and operatively associating the fuel nozzle with the fill opening to dispense fuel within the fuel tank; and engaging said coupling means with said fueling device by;

wrapping at least a portion of the first end portion of said retaining member around a portion of the fuel delivery device to form a closed, secure loop of flexible material around a portion of the fuel delivery device; and securing said post member within at least one of said openings to form a closed, secure loop around a portion of the fuel delivery device.

10. The method of claim 9 wherein said retaining member is generally hook-shaped.

11. The method of claim 9 further comprising a mounting bracket operatively coupled with the second end portion of said retaining member; said mounting bracket being secured to the vehicle.

12. The method of claim 11 wherein the second end portion of said retaining member is pivotably coup led with said mounting bracket, whereby said retaining member may pivot with respect to said mounting bracket, about a long axis of said retaining member.

13. The method of claim 11 wherein said mounting bracket is secured with the vehicle using an adhesive.

14. The method of claim 11 wherein the second end portion of said retaining member is removably coupled with said mounting bracket.

15. The method of claim 14 wherein a socket and post connector releasably couples the second end portion of said retaining member with said mounting bracket in a friction-fit manner.

16. The method of claim 15 wherein a long axis, extending through said socket and post connector, is positioned to generally point in the direction of the fill opening in the fuel tank.

* * * * *